United States Patent [19]

Trichell et al.

[11] Patent Number: 4,899,444

[45] Date of Patent: Feb. 13, 1990

[54] DISPOSABLE CLIPPER HEAD AND METHOD FOR MAKING THE SAME

[76] Inventors: John M. Trichell, 46 Bellaire Dr., Vicksburg, Miss. 39180; Ronald M. Wheeler, 31 Autumnwood Rd., Jackson, Miss. 39206

[21] Appl. No.: 194,197

[22] Filed: May 16, 1988

[51] Int. Cl.[4] ..... B26B 19/02

[52] U.S. Cl. ..... 30/208; 30/223; 29/428

[58] Field of Search ..... 30/223, 225, 208, 43.7; 29/425, 428

[56] References Cited

U.S. PATENT DOCUMENTS

| | | | |
|---|---|---|---|
| 2,928,171 | 3/1960 | Oster . | |
| 3,222,782 | 12/1965 | Sadlon . | |
| 4,328,616 | 5/1982 | Andes | 30/225 |
| 4,328,616 | 5/1982 | Andis . | |
| 4,563,814 | 1/1986 | Trichell et al. . | |

*Primary Examiner*—Frank T. Yost
*Assistant Examiner*—Willmon Fridie
*Attorney, Agent, or Firm*—Laubscher, Presta and Laubscher

[57] ABSTRACT

A unique one-piece disposable clipper head is characterized by the provision of a synthetic plastic base molded as a unitary structure about two metal cutting blades which are integrally formed with the base during an insertion molding process. The base includes a fixed portion with which the lower cutting blade is integrally formed and a movable portion with which the upper cutting blade is integrally formed. The upper movable portion and the lower fixed portion of the base are initially formed as a unitary structure. Following molding of the base, the movable portion is separated from the fixed portion to afford horizontal or lateral displacement of the movable portion and the upper blade relative to the fixed base portion and the lower blade. The base contains a recess in the bottom surface thereof for receiving the clamping mechanism of an electric clipper for attachment thereto. The base also includes on its upper surface in addition to the movable portion a plurality of projections for alignment and connection with the drive mechanism of the clipper. The metal cutting blades each have a planar configuration and are arranged in contiguous parallel relation, and both include a forward toothed edge arranged adjacent one another. When the clipper is turned on, the clipper drive mechanism laterally displaces the movable portion and the second blade relative to the first blade, whereby hair arranged between the toothed forward edges of the fixed and movable blades is cut.

11 Claims, 2 Drawing Sheets

DISPOSABLE CLIPPER HEAD AND METHOD FOR MAKING THE SAME

BACKGROUND OF THE INVENTION

The present invention relates to an improved disposable clipper head made of synthetic plastic material and including metal cutting blades which are used for clipping hair. The clipper head is particularly adapted for use in prepping patients for surgery by quickly and efficiently removing body hair from the surgical area of the patient's body.

More particularly, the clipper head according to the invention is adapted for connection to an electric clipper and is then used to prep a patient in a sterile environment. As opposed to prior manual prepping techniques wherein a patient is shaved with a sharp razor, surgical prepping with the new clipper head does not produce nicks or cuts in the patient's skin which may result in post-operative infections. Following use, the head is removed from the clipper and disposed of, with a new head being used to prep the next patient.

The clipper head according to the invention is manufactured using a novel insertion molding assembly process for mass production at very low costs.

BRIEF DESCRIPTION OF THE PRIOR ART

Electric hair clippers and cutting heads therefor are well known in the patented prior art as evidenced by the patents to Oster U.S. Pat. No. 2,928,171, Sadlon U.S. Pat. No. 3,222,782, and Andis U.S. Pat. No. 4,328,616. The Oster patent, for example, discloses a conventional three piece cutting head assembly including a stationary bottom blade, a movable top blade, and a spring member. Each piece of the assembly is formed of metal, and the assembly is connected together with a pair of screws. The cutting head assembly is removably connected with the body of an electric clipper by way of a tongue and strap assembly.

The Sadlon patent discloses a four-piece cutting assembly held together by screws and including two shearing blades, an assembly yoke, and a spring. Finally, Andis discloses an even more complex seven-piece cutting head assembly wherein the fixed and movable blades are each of laminated two-piece construction.

While the prior devices normally operate quite satisfactorily, they each possess a number of inherent drawbacks which reduce their practicality for use in a hospital environment. Specifically, each of the prior devices comprises a relatively complex and expensive assembly. Where any of the prior devices is to be used in an operating room to remove hair from a patient about to undergo surgery, it is necessary to insure that the cutting head is sterile. Accordingly, after every use, the head must be removed from the clipper for sterilization. Moreover, in order to completely sterilize the head, it is often necessary that the head be disassembled. The repeated disassembly and sterilization of the head is a time-consuming and costly procedure. Moreover, when the cutting blades have become worn, it is necessary either to sharpen the blades or replace the head, again adding to the maintenance costs of the device.

In order to overcome these drawbacks, the inventors developed the two-piece synthetic plastic disposable clipper head disclosed in the Trichell et al U.S. Pat. No. 4,563,814. A primary drawback of this prior device was the inability of the synthetic plastic teeth of the head to remain sharp enough to efficiently cut hair.

The present invention was developed to overcome these deficiencies of the prior clipper heads by providing an inexpensive disposable synthetic plastic clipper head including metal inserts defining the cutting teeth of the head. The metal inserts improve cutability, maintain greater sharpness of the cutting teeth, and have less distortion due to heat build-up during the clipping process.

SUMMARY OF THE INVENTION

Accordingly, it is primary object of the present invention to provide a disposable clipper head for use with an electric clipper for clipping hair. The head includes a base formed of synthetic plastic material and containing a recess in the bottom surface thereof for receiving the clamping mechanism of the electric clipper. The base comprises lower fixed and upper movable portions adapted for connection with the reciprocating drive mechanism of the clipper. A pair of metal cutting blades are connected with the fixed and movable portions of the base, respectively, and are arranged in contiguous relation, with the blade connected with the movable base portion resting on the blade connected with the fixed base portion. Each cutting blade has a generally rectangular configuration and includes a toothed forward edge, the toothed edges of the blades being superimposed. When the clipper is operated, the clipper drive mechanism laterally displaces the base movable portion and the upper blade relative to the fixed lower blade for clipping hair.

According to another object of the invention, the blades contain aligned openings for receiving hook portions of the base fixed portion which clamp the two blades together.

It is a further object of the invention to provide a rigid synthetic plastic blade support which is adhesively connected with the movable cutting blade to prevent deformation of the cutting blade during use.

Another object of the invention is to provide a unique method for manufacturing the clipper head using insertion molding. More particularly, the metal cutting blades are arranged in a mold in a stacked contiguous relation and the synthetic plastic material is insertion molded about the blades to form the rigid base. The base, which is formed as a unitary structure, includes an upper portion arranged above the top cutting blade, the upper portion being connected with the remainder of the base by one or more webs of synthetic plastic material. After hardening of the base, the connecting webs are broken by laterally displacing the upper portion of the base from the lower portion thereof to define the lower fixed and upper movable portions of the base.

BRIEF DESCRIPTION OF THE FIGURES

Other objects and advantages of the present invention will become apparent from a study of the following specification when viewed in the light of the accompanying drawing, in which.

DETAILED DESCRIPTION

Referring first to FIGS. 1–4, the disposable clipper head according to the subject invention will be described. The clipper head 2 includes a base member 4 formed of synthetic plastic material. The plastic material may comprise any of the variety of synthetic resins, either filled or unfilled, which when molded are characterized by a rigid construction.

Figure 6:
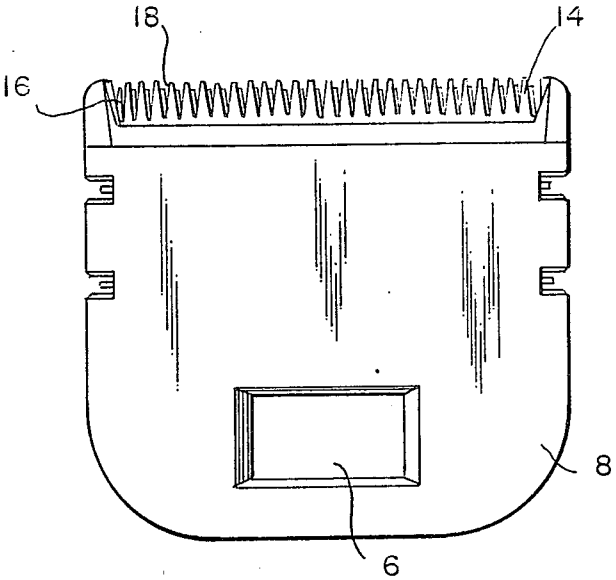
Figure 4:
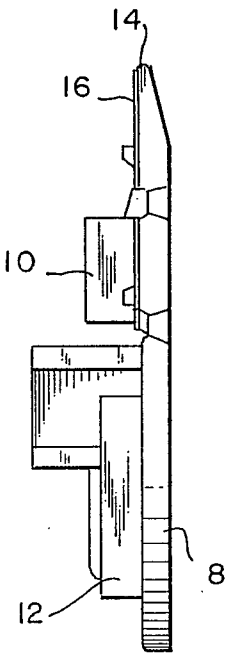
FIGS. 2, 3, and 4 are rear, top, and side plan views, respectively, of the head of FIG. 1.
Figure 2:
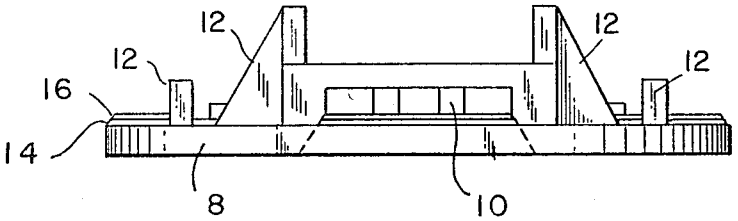

As shown in FIG. 6, the base contains in its bottom surface a recess 6 which is provided for receiving the clamping mechanism of an electric clipper (not shown) normally used for removing hair. A typical electric clipper is of the type shown in the Oster U.S. Pat. No. 2,928,171. This clipper has a tongue-like clamping mechanism which pivots away from the clipper end portion of the clipper whereby the clipper head according to the invention may be quickly inserted or removed from the electric clipper.

The clipper head base 4 includes a fixed lower portion 8 and a movable upper portion 10 which is adapted for connection with the reciprocating drive mechanism of the electric clipper. The fixed portion of the base 4 also includes a number of projections 12, which assist in locating the clipper head relative to the clipper and which are adapted for engagement with recesses in the electric clipper to maintain the base lower portion 8 in a rigid condition during operation of the clipper drive mechanism. As will be developed below, the clipper drive mechanism is operable to reciprocate the upper movable portion 10 of the base 4 relative to the fixed lower portion thereof.

Figure 1:
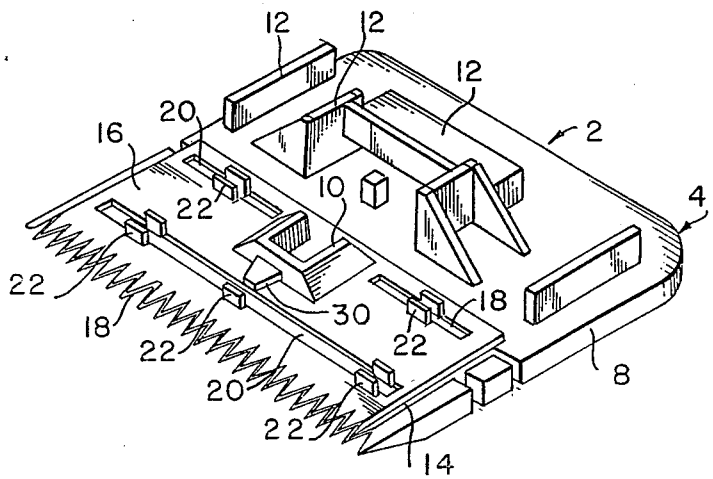
FIG. 1 is a perspective view of a first embodiment of the disposable clipper head according to the invention.
Figure 3:
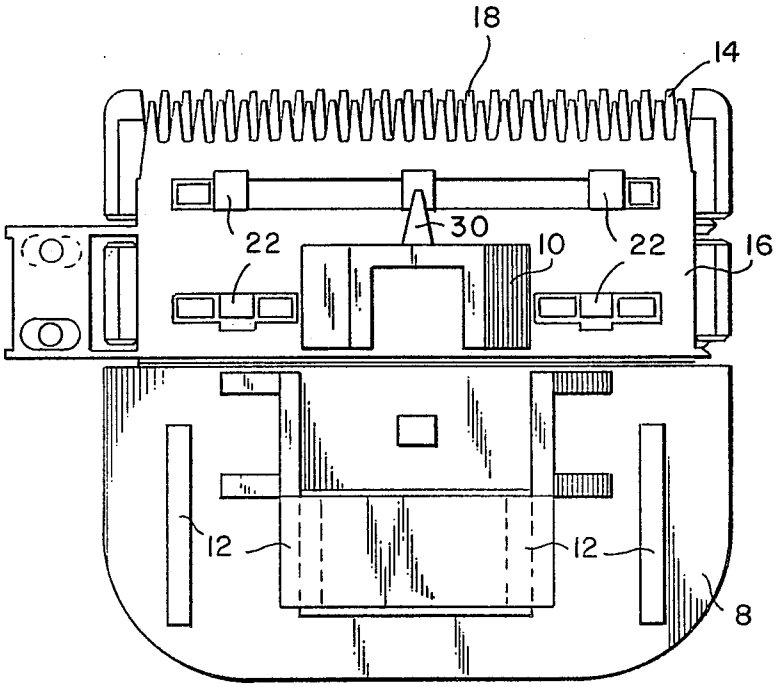

A pair of metal cutting blades are connected with the fixed and movable portions of the base 4. More particularly, a first cutting blade 14 is connected with the fixed lower portion 8 of the base and a second cutting blade 16 is connected with the base upper movable portion 10. Both cutting blades are relatively thin and have a planar rectangular configuration as shown in FIGS. 1 and 3. The blades are arranged in stacked contiguous relation whereby the second blade 16 is laterally displaced relative to the lower fixed first blade 14 during operation of the clipper drive mechanism to reciprocate the movable portion 10 of the clipper head base 4. The forward edges of each cutting blade have a plurality of teeth 18 with the toothed edges of the being superimposed. When the clipper drive mechanism is operated to reciprocate the upper cutting blade relative to the fixed lower blade, hair arranged between the blades is clipped by the toothed portions of the blades. The cutting blades which have a thickness of between 0.005 and 0.025 inches are formed of any suitable metal such as stainless steel and can be mass produced at a very low cost.

As shown in FIGS. 1 and 3, the blades each contain a plurality of aligned openings 20. These openings are adapted to receive hook portions 22 connected with the base fixed portion 8 to clamp the first and second blades together while still affording lateral displacement of the upper blade 16 relative to the lower blade 14. As will be developed below, the hook portions 20 are integrally formed with the base fixed portion 8 during the molding operation.

Figure 5:
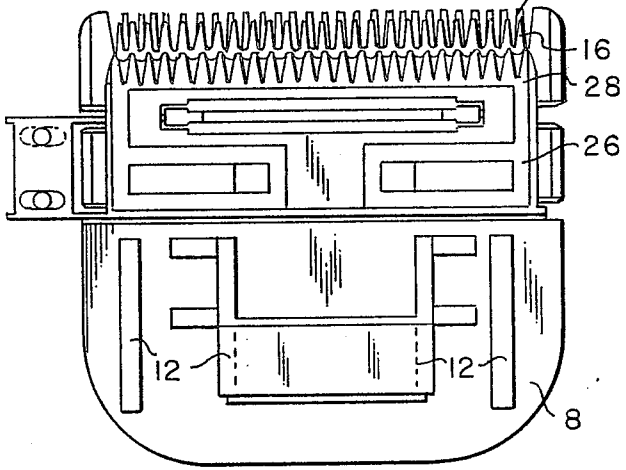
FIGS. 5 and 6 are top and bottom plan views of an alternate embodiment of the clipper head according to the invention.

Referring now to FIG. 5, an alternate embodiment of the invention will be described. This embodiment is similar to that of FIGS. 1–4 but the upper movable portion of the base comprises a rigid support member 24 connected with the upper blade 16 to prevent the upper blade from being deformed from its planar configuration during use of the clipper. The support member also has a generally rectangular configuration and is adapted to extend about the periphery of the upper second cutting blade 16. A plurality of teeth 26 may be molded into the forward edge of the support for alignment with the teeth of the upper blade for insuring that the upper blade teeth remain adjacent the lower blade teeth for optimum cutting operation. The support member 24 is also formed of a synthetic plastic material and is connected with the upper surface of the second blade 16 by a layer of adhesive, or is integrally formed therewith via insertion molding as will be developed below. Similarly, the first and second cutting blades are connected with the fixed 8 and movable 10 portions of the base by a suitable adhesive, or by insertion molding.

A characterizing feature of the present invention is the method for manufacturing the improved clipper head. This method of manufacture lends itself to mass production using assembly line techniques. Initially, a pair of cutting blades such as the upper and lower blades 16, 14 are arranged as inserts in the mold of an insertion molding device. The blades are initially held in a stacked contiguous orientation following which the synthetic plastic material is insert molded about the blades in a heated fluent condition to define a unitary base having the configuration shown in the drawing. More particularly, the synthetic plastic material is first molded beneath the metal blades to define the base 4 and the projection portions 12 thereof, following which the synthetic plastic material is passed through the openings 20 in the blades to form the hook portions 22 and the upper movable portion 10. Initially, the upper movable portion 10 is directly connected with a base fixed portion via a web 30 of synthetic plastic material protruding through the front opening contained in the cutting blades. Thus, the movable portion 10 of the base, which is arranged in the upper portion of the base, is intially integrally formed with the base. After the synthetic plastic material of the base hardens, the complete clipper head is ejected from the mold for further cooling to form the final product. Next, the movable portion 10 of the base is displaced laterally relative to the base fixed portion 8 to separate the movable portion from the fixed portion by tearing the synthetic plastic material at the web 30. In this manner, the clipper head is separated into the fixed and movable portions, with the fixed portion including the integral lower cutting blade 14 and the movable portion including the integral upper cutting blade 16. The detached assembly is then connected with the electric clipper for use in clipping the hair of a patient prior to surgery.

The clipper head of the embodiment of FIG. 5 is formed in the same manner as that of FIGS. 1–4 except that a different mold is used to form the support member 26 rather than the upper portion 10 of FIG. 1. In this embodiment, a web (not shown) of synthetic plastic material is initially formed between the support and the fixed portion 8, with the web subsequently being torn, whereby the support 26 and upper blade 16 are movable relative to the fixed portion and lower blade.

Through the use of insertion molding, the upper and lower blades are embedded within the synthetic plastic material of the upper and lower portions of the base, whereby the blades are affixed to the respective portions of the base. If desired, layers of adhesive may be applied to the upper surface of the upper blade and the lower surface of the lower blade prior to molding, whereby the blades are further secured to the base during the molding process via the adhesive.

Referring once again to FIGS. 1 and 3, it is shown that the hook portions 22 of the base fixed portion 8 are arranged in two parallel rows, with one row being as close to the toothed forward edge portions 18 of the blades as possible and the other row being as close to the rear edge of the blades as possible. This allows the upper blade to move laterally in a controlled horizontal manner. The tension provided by the plastic hook portions in these two rows maintains greater tension at the two front and rear portions of the blades and prevents separation of the blades.

The metal cutting blades may be inserted into the molding apparatus either individually or via continuous reels. The manufacturing process includes proper alignment of the cutting blades, molding of the synthetic plastic material around the blades, disconnection of each finished unit from a reel of metal blades, side-to-side movement to break the plastic web portion of the synthetic plastic material to create the movable portion of the clipper head, and finally feeding the completed clipper head into an automatic packaging unit where the devices may be packaged in a sterile condition for subsequent use. The metal blades are formed with variable sizes and configurations of cutting teeth to accomodate hair of varying thickness and texture.

The use of the metal cutting blades, which are essentially inserts for the synthetic plastic disposable clipper head, improve the cutability of the clipper head while maintaining the sharpness of the cutting blades. These metal blades also have less distortion due to heat buildup during the clipping process than is developed in the prior synthetic plastic cutting blade of the Trichell et al U.S. Pat. No. 4,563,814.

When used in prepping a patient in surgery, the clipping head according to the present invention is preferably connected with a combined clipper and vacuum assembly as disclosed in the Trichell et al U.S. Pat. No. 4,667,405. Such an assembly is particularly suitable for use in a sterile hospital environment to prep the patient for surgery since the suction assembly connected with the clipper is used to remove the hair from the patient as it is cut by the clipper head.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A disposable clipper head for attachment to an electric clipper for clipping hair, comprising (a) a rigid base formed of synthetic plastic material, said base containing a recess in the bottom surface thereof for receiving the clamping mechanism of the electric clipper for attachment thereto, said base including fixed and movable portions adapted for connection with the reciprocating drive mechanism of the clipper, said fixed portion including hook means;

(b) a first planar metal cutting blade connected with said base fixed portion and containing an opening;

(c) a second planar metal cutting blade connected with said base movable portion in contiguous relation above said first cutting blade and containing an opening aligned with said first blade opening, said hook means extending through said aligned openings for clasping said first and second blades together, said first and second cutting blades each having a generally rectangular configuration and including a toothed forward edge, said toothed edges of said first and second blades being superimposed, whereby when the clipper is turned on, the clipper drive mechanism laterally displaces said base movable portion and said second blade relative to said first blade for clipping hair.

2. A clipper head as defined in claim 1, wherein said movable portion comprising a rigid blade support formed of synthetic plastic material and connected with the upper surface of said second blade, said blade support retaining the planar configuration of said second blade.

3. A clipper head as defined in claim 2, wherein said blade support is adhesively secured to said second blade.

4. A clipper head as defined in claim 3, wherein said blade support includes a toothed front edge arranged adjacent said second blade toothed edge to prevent the portions of said second blade from being bent away from the tooth portions of said first blade.

5. A clipper head as defined in claim 3, wherein said first and second metal blades are connected with said based fixed and movable portions, respectively, by a layer of adhesive.

6. A clipper head as defined in claim 2, wherein said first and second metal blades are connected with said base fixed and movable portions by insert molding.

7. A clipper head as defined in claim 6, wherein said fixed and movable portions of said base are initially formed as a unitary assembly about said first and second blades, said fixed and movable portions subsequently being separated.

8. A method for manufacturing a disposable clipping head for attachment to an electric clipper for clipping hair, comprising the steps of (a) inserting a pair of metal cutting blades containing aligned openings into a mold, said blades being arranged in a stacked contiguous relation and each including a toothed forward edge;

(b) molding a base of synthetic plastic material about said cutting blades, said base containing in its lower surface a recess for receiving the clamping mechanism of the electric clipper for attachment thereto, the upper portion of said base being insert molded via said openings and including means adapted for connection with the reciprocating drive mechanism of the clipper; and (c) separating said base upper portion from the remainder of said base, whereby said base upper portion and the top one of said cutting blades are movable relative to said base and the bottom one of said cutting blades.

9. A method as defined in claim 8, and further comprising the step of adhesively connecting one of said blades with said base and said upper portion, respectively.

10. A method as defined in claim 9, and further comprising the step of molding a support member with said top blade.

11. A method as defined in claim 10, wherein said support member is adhesively connected with said top blade.

* * * * *